United States Patent [19]

Bloch et al.

[11] Patent Number: 4,737,301

[45] Date of Patent: Apr. 12, 1988

[54] POLYCYCLIC THIOPHENE LUBRICATING OIL ADDITIVE AND METHOD OF REDUCING COKING TENDENCIES OF LUBRICATING OILS

[75] Inventors: Ricardo Bloch, Scotch Plains, N.J.; Ghazi B. Dickakian, Houston, Tex.

[73] Assignee: Exxon Chemical Patents Inc., Linden, N.J.

[21] Appl. No.: 876,461

[22] Filed: Jun. 20, 1986

Related U.S. Application Data

[63] Continuation-in-part of Ser. No. 786,929, Oct. 11, 1985, Pat. No. 4,619,756, which is a continuation of Ser. No. 722,865, Apr. 11, 1985, abandoned.

[51] Int. Cl.[4] ..... C10M 135/34

[52] U.S. Cl. ..... 252/45

[58] Field of Search ..... 252/45

[56] References Cited

U.S. PATENT DOCUMENTS

| | | | |
|---|---|---|---|
| 2,528,782 | 11/1950 | Reiff | 252/45 |
| 2,528,785 | 11/1950 | Richter et al. | 252/41 |
| 2,560,956 | 7/1951 | Johnson | 252/45 |
| 2,704,275 | 3/1955 | Brooks | 252/45 |
| 2,932,615 | 4/1960 | Jordan et al. | 252/45 |
| 3,124,532 | 3/1964 | Ayers | 252/45 |
| 3,231,585 | 1/1966 | Reifschneider | 252/45 |
| 3,250,787 | 5/1966 | Reifschneider | 252/45 |
| 3,265,710 | 8/1966 | Ayers | 252/45 |
| 3,395,101 | 7/1968 | Clark et al. | 252/45 |
| 3,458,117 | 7/1969 | Munch et al. | 252/45 |
| 3,642,631 | 2/1972 | Gisser et al. | 252/45 |
| 4,124,514 | 11/1978 | Yaffe | 252/46.7 |
| 4,330,302 | 5/1982 | Taylor | 252/45 |
| 4,427,530 | 1/1984 | Dickakian | 208/22 |
| 4,427,561 | 1/1984 | Kusayanagi et al. | 252/45 |
| 4,431,512 | 2/1984 | Dickakian | 208/44 |

*Primary Examiner*—William R. Dixon, Jr.
*Assistant Examiner*—Ellen McAvoy
*Attorney, Agent, or Firm*—S. H. Markowitz

[57] ABSTRACT

Inexpensive lubricating oil antioxidants having a solubilizing group which comprises alkyl and cycloalkyl-substituted aromatics and a reducing thiophenyl group, which are useful motor oil additives. Method of reducing coking tendencies of lubricating oils by incorporating the substituted aromatic antioxidants.

33 Claims, 3 Drawing Sheets

POLYCYCLIC THIOPHENE LUBRICATING OIL ADDITIVE AND METHOD OF REDUCING COKING TENDENCIES OF LUBRICATING OILS

DESCRIPTION OF THE INVENTION

1. Cross-Reference to Related Applications

This application is a Continuation-in-Part of copending, commonly assigned U.S. patent application Ser. No. 786,929 filed on Oct. 11, 1985 now U.S. Pat. No. 4,619,756, which is a continuation of Ser. No. 722,865 filed Apr. 11, 1985, now abandoned, the contents of both of which are incorporated by reference thereto.

DESCRIPTION OF THE INVENTION

2. Technical Field of the Invention

This invention relates to the use of sulfur-containing polynuclear aromatic oils, specifically polycyclic thiophene derivatives, as additives for lubricating oils. The invention further relates to reducing the tendancy of lubricating oils to oxidize or degrade generally by incorporating the additives of the invention.

3. Background Art and Relevant Materials

Lubricating oils are widely used to reduce friction, protect against corrosion, and dissipate heat buildup in a variety of applications. Because such properties are seldom all achieved to a satisfactory degree using a lubricating oil alone, various additives have been developed for lubricating oil basestocks to improve their performance, e.g. anti-oxidants, viscosity index (VI) modifiers, flow improvers, corrosion inhibitors, etc.

Lubricating oils are a selected fraction of refined mineral oils used for the lubrication of (usually metallic) moving surfaces ranging from small precision machinery to the heaviest equipment. The oils generally contain small amounts of additives to impart desired properties such as viscosity and detergency, and range in viscosity from thin liquids to grease-like substances; unlike lubricating greases, they contain no solid or fibrous materials.

As used herein the term "lubricanting oils" extends to a wide variety of oils having lubricative abilities including: automotive oils, heavy duty oils, marine oils, railroad oils, aviation lube oils, transmission fluids, hydraulic fluids, etc.

Lubricating oils are complex mixtures and, particularly when used in an internal combustion engine, are susceptible to breakdown caused by the high temperatures encountered during operation. While the chemistry of such breakdown is not fully understood, it is believed that oxidation plays a significant role, and for this reason it is known to add anti-oxidants to lubricating oils intended for such use. It is generally necesary to formulate a desired anti-oxidant for inclusion into the lubricating oil, e.g. by dissolving it in an appropriate oil-miscible solvent and/or adding a suitable dispersant to form an antioxidant-containing blend which is then added to the lubricating oil base.

Suitable lubricating oil anti-oxidant additives are well known in the art and include alkyl phenols, alkyl amines, zinc dithiophosphite or zinc phosphate (D.P.), and sulfurized oils.

Such known anti-oxidants, while generally suitable for their intended purposes, suffer from a number of practical drawbacks among which are the cost of the active anti-oxidant ingredient and of formulating it into an acceptable blend for addition to the lubricating oil base.

More specifically, alkyl phenol additives suffer corrosion problems which tend to limit their usage. Alkyl amines are relatively expensive such that their use too, is limited, while zinc D.P. suffers water stability problems which likewise limit its usage. Sulfurized oils suffer the disadvantage of polysulfide which are known to be highly corrosive.

Alkyl-substituted, thiophene-containing polycondensed aromatic naphthenic compounds of 2–6 rings which are obtained as by-products of catalytic cracking, steam cracking, and coal gasification and liquification processes have been identified for use in combination with naphthenic compounds for in inhibiting accumulation of carbonaceous, materials, and their structure described in the aforementioned copending U.S. patent application Ser. No. 786,929, filed Oct. 11, 1985. Briefly, such compounds have a number average molecular weight ($\overline{M}n$) of 200–1000, and represent one of three major classes of alkyl-substituted aromatic compounds obtained in such processes, i.e. hydrocarbon aromatics, sulfur-containing aromatics, and oxygen-containing aromatics; these sulfur-containing aromatics typically represent about 15–35 percent by weight (depending in part on the nature and sulfur content of the starting material) of the alkyl substituted aromatic by-products obtained in such processes.

Such sulfur-containing alkyl-substituted aromatic compounds typically include, but are not limited to, mixtures of indo-thiophenes, naphtho-thiophenes, naphthenonaphtho-thiophenes, acenaphthalene-thiophenes, anthraceno-thiophenes, naphthenophenanthro-thiophenes, pyreno-thiophenes, chryseno-thiophenes, cholanthreno-thiophenes, indeno-thiophenes, and naphthenobenzo-thiophenes.

Compounds derived from extracts of polynuclear oil have been described for use as lube additives, e.g. Ayers U.S. Pat. No. 3,124,532 describes derivatives of polynuclear sulfur- or nitrogen-containing heterocyclic compounds which are obtained from the solvent extracts of mineral lubricating oil; the heterocyclic compounds contain alkyl groups with halogen, hydroxyl, amine, nitrile, carboxyl, and disulfide substituents.

The patent fails to identify any particular aromatics as being of use as antioxidants, but rather refers to polynuclear compounds generally. In discussing the types of compounds present thiophenes are not mentioned, and if indeed thiophenes were present, there is no suggestion that they would be present in an amount and concentration sufficient to function for their intended purpose according to the invention.

Richter et al., in U.S. Pat. No. 2,528,785, decribess alkyl 2-amino, 8-amino, and 2,8-diamino derivatives of dibenzothiophenes which are produced by synthetic routes and not directly from petroleum as lubricant additives. These compounds suffer the drawbacks of the amine class of additives discussed above, namely the increased costs which are associated with such compounds. The compounds of the invention contain no amino groups.

Hofer, in German DES No. 2,111,444 published Sept. 23, 1971, proposed the use of 3,5-dialkylhydroxybenzyl dibenzofuran and 3,5-dialkylhydroxybenzyl dibenzothiophene as stabilizers for polypropylene and paraffin oils. The compounds of the invention contain no hydroxy groups.

Yaffe, U.S. Pat. No. 4,124,514 describes a number of antioxidant lubricating oil additives for pentaerythritol ester lubricating oils, including dibenzothiophene and others. However, such compounds exhibit relatively low solubilities for use with the lubricants of the invention.

It can be seen from the above prior art efforts to provide lubricating oil antioxidants that there still exists a need for such compounds which can be readily and inexpensively obtained, exhibit good antioxidant activity at low concentrations, and be readily miscible with lubricating oils without the need for expensive formulations.

SUMMARY OF THE INVENTION

Accordingly, it is a general object of the present invention to provide lubricating oil antioxidants which avoid or minimize the aforementioned drawbacks of the prior art, and specifically, to provide inexpensive, noncorrosive and effective antioxidant additives.

Another object of the present invention is to provide lubricating oil antioxidants which are readily soluble or miscible in a wide variety of lubricating oils and therefore do not require formulation with other ingredients.

A further object of the present invention is to provide such antioxidants which can be obtained inexpensively as a by-product of oil refining and coal liquification or gasification.

An additional object of the present invention is to provide such antioxidants which exhibit good compatibility with other known lubricating oil additives.

A more particular object of the present invention is to provide lubricating oil compositions having an effective amount of such antioxidants incorporated therein.

Upon study of the specification and appended claims, further objects, features and advantages of the present invention will become more fully apparent to those skilled in the art to which this invention pertains.

The above objects are achieved by modifying a lubricating oil composition formed of an organic lubricating oil susceptible to oxidative polymerization to form $C_7$-asphaltenes by incorporating an effective amount of the inventive additive. Generally, it is contemplated that the lubricating oil be a motor oil or the like. The antioxidant generally comprises an antioxidant effective amount of at least one alkyl or cycloalkyl-substituted thiophene containing polycondensed aromatic comound of 2–6 rings alkyl or cycloalkyl substituted with 1–12 carbon atoms to provide solubility of the at least one thiophene in the lubricating oil composition. More preferably, the at least one thiophene is a member selected from the group consisting of indo-thiophenes, naphtho-thiophenes, naphthenonaphtho-thiophenes, acenaphthalene-thiophenes, anthraceno-thiophenes naphthenophenanthro-thiophenes, pyreno-thiophenes, chryseno-thiophenes, cholanthreno-thiophenes, and indeno-thiophenes and naphthenobenzo-thiophenes. The at least one member is preferably present in an amount greater than 0.1% by weight of the composition.

The antioxidant most preferably has an alkyl substitutent of 2–12 carbon atoms.

Advantageously, the antioxidant is a by-product of certain conventional catalytic, steam or thermal cracking processes and is an aromatic distillate having a negative viscosity index, and has has a kinematic viscosity of about 1–10 Centistokes at 100 degrees C. The antioxidant compounds have an Mn=200–1000, preferably 200–300 and typically have a boiling point of 200–550 degrees C.

The antioxidant generally has a paraffinic:aromatic weight ratio of 60–30:40–70; and aliphatic:naphthenic weight ratio of 80–20:20–80; and a (thiophenic:aromatic)+paraffinic weight ratio of 10–70:90–30.

Most preferably, each of the constituents of the antioxidant has a paraffinic:aromatic weight ratio of 60–40:40–60, an aliphatic:naphthenic weight ratio of 60–40:40–60 and a thiophenic:(aromatic+paraffinic) weight ratio of 30–50:70–50.

The invention is further directed to a method of reducing the coking tendency of lubricating oils by incorporating effective amounts of the aromatic thiophene-containing compounds.

BRIEF DESCRIPTION OF DRAWINGS

The following detailed description of the invention may be better understood with reference to the annexed drawings, in which.

DETAILED DESCRIPTION OF THE INVENTION

Figure 1:
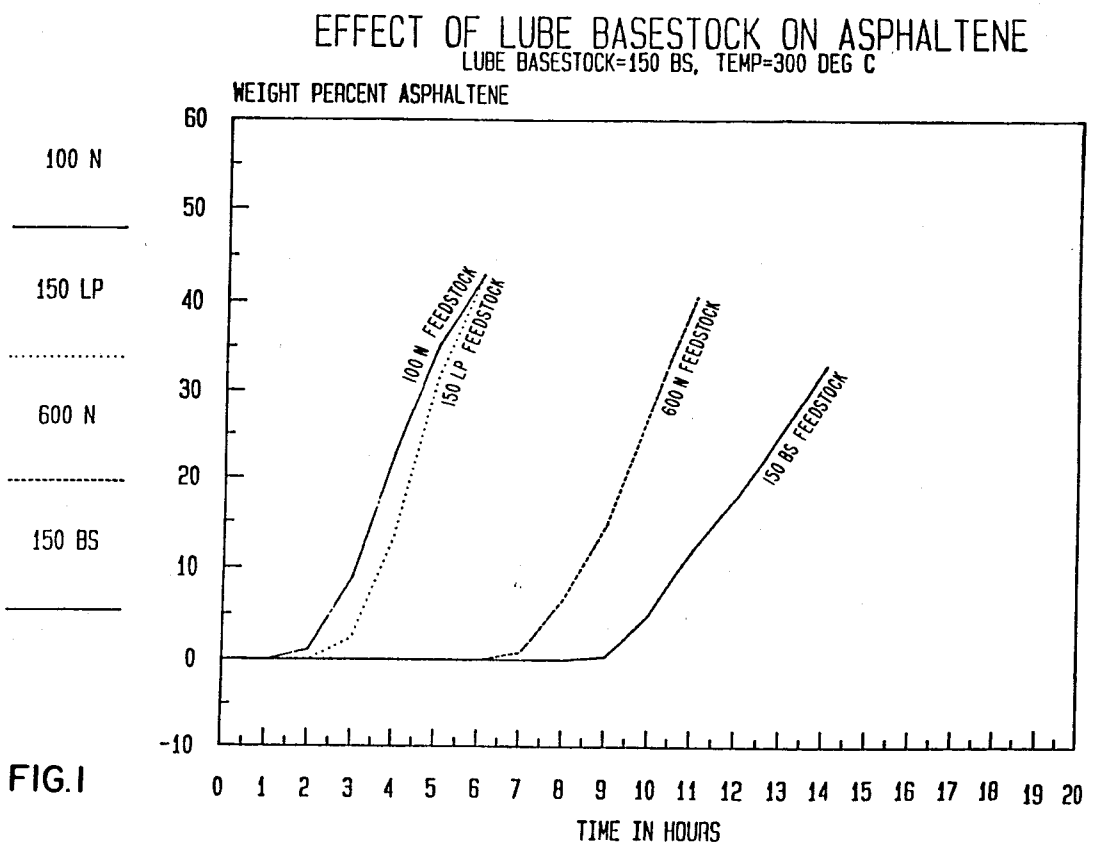
FIG. 1 shows the rate of $C_7$-asphaltene formation in a single four lubricating oil basestocks (150 brightstock, 600 Neutral, 150 Neutral Low Pour, and 100 Neutral) at 300 degrees C. containing no added antioxidant (control).

Briefly, the above and other objects, features and advantages of the present invention are attained in one aspect thereof by providing a lubricating oil or grease thereof and an antioxidant-effective amount of alkyl or cycloalkyl-substituted, thiophene-containing polycondensed aromatic compounds of 2–6 rings having an alkyl or cycloalkyl group of 1–12 carbon atoms, preferably 2–12 carbon atoms and which can be ringed, linear or branched. The chemical formula of the compounds generally is $C_nH_{2n-12}S$ to $C_nH_{2n-36}S$.

While the alkyl or cycloalkyl, naphthenic and aromatic portions of the molecules function as a solubilizing agent, the thiophene-containing portion of the molecule provides anti-oxidation properties. Thus, to the extent that other moieties are present, these moities must not sterically hinder the thiophene portion and mask its effects.

Suitable polycyclic rings include, but are not limited to, one or more indo-thiophenes, naphtho-thiophenes, naphthenonaphtho-thiophenes, acenaphthalene-thiophenes, anthraceno-thiophenes, naphthenophenanthro-thiophenes, pyreno-thiophenes, chryseno-thiophenes, cholanthreno-thiophenes, indeno-thiophenes, and naphthenobenzo-thiophenes.

Presently preferred thiophene-containing polycondensed aromatic alkylated and cycloalkylated compounds of 2–6 rings are obtained as by-products of catalytic cracking, thermal cracking, steam cracking, and coal gasification and liquification processes have been identified and their structure described in the aforementioned copending U.S. patent application Ser. No. 786,929. Briefly, such compounds represent one of three major classes of aromatic compounds obtained in such processes, i.e. hydrocarbon aromatics, sulfur-containing aromatics, and oxygen-containing aromatics. The sulfur-containing aromatics typically represent about 15–35 percent by weight (depending in part on the nature and sulfur content of the starting material) of the aromatic by-products obtained in such processes. A convenient and inexpensive source of the thiophene-containing polycondensed aromatic compounds useful in the present invention is the sulfur-containing aromatic oils obtained as a by-product in the distillation of cat cracker bottoms or from catalytic cracking processes, or steam cracker tars from steam cracking processes.

By way of example, as is disclosed in U.S. Pat. No. 4,431,512, a typical steam cracker tar middle distillate contains approximately 10–11 percent thiophenes (see Table 4 of the patent). U.S. Pat. No. 4,427,530 illustrates that a typical cat cracker bottom distillate fraction (427–510 degree C.) contains approximately 20%, or more, thiophenic fraction. All of the above techniques provide compounds which are alkylated and cycloalkylated according to the invention.

Exemplary procedures of producing and distilling the above alkylated and cycloalkylated fractions are disclosed in the above patents, the disclosures of which are herein incorporated by reference thereto. It is noted however that although these patents may not mention that the compounds of the stated fractions are alkylated and cycloalkylated, this indeed the case and these compounds are useful according to the invention.

As disclosed in U.S. Pat. No. 4,431,512, the middle fraction is formed by cracking gas oils, particularly virgin gas oil, or naphtha, at temperatures of from about 700 degrees C. to about 1000 degrees C. The residues formed are then fractionally distilled into a middle distallate fraction. The middle fraction taken at 370–490 degrees C., at 760 mm Hg. has high aromaticity and narrow molecular weight distribution. It contains no ash or solid particulate and contains substantially no high coking asphaltene. Table 3 of the patent indicates the characteristics of the middle fraction. The molecular structure of the fraction, as determined by high resolution mass spectrometer is given in Table 4 of the patent. Alternatively, the inventive composition may also be prepared by means of alternative procedure disclosed beginning at column 5 of the patent. The compounds produced are alkylated and cycloalkylated within the terms of the invention.

Yet other techniques of forming the composition of the invention are disclosed in U.S. Pat. No. 4,427,530, the disclosure of which is hereby incorporated by reference thereto. According to this technique a cat cracker bottom is distilled into seven fractions, of which the fraction distilling at 427–510 degrees C. contains the antioxidant compounds of interest. The percentages of compounds present are shown in Table 3 of the patent.

The thiophene containing fractions themselves may, if desired, then be further purified by additional distillation. Once again, the thiophenes are alkylated and cycloalkylated within the terms of the invention.

Suitable lubricating oils to which the antioxidants of the present invention can be added are those refined high lubricity mineral oils characterized as automotive oils, heavy duty oils, marine oils, railroad oils, aviation lubes, transmission fluid, and hydraulic fluids. More generally, the additive is useful with any parrafinic and/or naphthenic based stocks in which oxidation is a significant concern wherein the viscosity is from approximately 3–60 centistokes. The oils are preferably natural, but may also be synthetic, e.g., polyalphaolefins and synthetic esters.

As used herein, the term "oxidation" is taken most broadly so as to include all reactions of hydrocarbons with air, oxygen, nitrogen oxides, sulphur oxides, ozone, etc. which have a tendency to degrade the lubricating oil with time, and reduce its effectiveness.

One technique of measuring the effectiveness of the additives of the invention is based in part upon the discovery that the initial higher molecular weight species which are formed as the result of lubricating oil basestock oxidation are a complex mixture of n-heptane insolubles ($C_7$-asphaltenes). Based upon this finding, the effectiveness of lubricating oil antioxidants can now be determined by monitoring the rate of $C_7$-asphaltene formation under controlled conditions.

The antioxidants of the present invention can be used in virtually any composition of matter comprising an organic material susceptible to oxidative polymerization of $C_7$-asphaltenes, and have been found to be useful in even small amounts of greater than 0.1 to about 10%, and preferably in amounts of greater than 0.1 to about 2%, and most preferably about 0.2–0.8% by weight, based on the total compositions. The amount used is thus greater than that which might naturally be present in certain oils, depending upon how they are made. Given the relatively low cost of the inventive additive, it is theoretically practical and desirable to use as much of the additive as possible. However, the viscosity of the additive increases substantially at reduced temperatures such that there is a practical maximum amount of additive which may be incorporated without adversely affecting the properties of the lubricant itself.

The antioxidant comprises at least one and preferably a mixture of alkyl or cycloalkyl-substituted compounds of indo-thiophenes, naphtho-thiophenes, naphthenonaphtho-thiophenes, acenaphthalene-thiophenes, anthraceno-thiophenes, naphthenophenanthro-thiophenes, pyreno-thiophenes, chryseno-thiophenes, cholanthreno-thiophenes, indeno-thiophenes, and naphthenobenzo-thiophenes, the compound being substituted by an alkyl or cycloalkyl group of 1–12 carbon atoms to provide solubility of the compound in the lubricant.

The polycyclic antioxidants of the present invention must bear an alkyl or cycloalkyl substituent in order to provide the compounds with suitable solubility in lubricating oil compositions. The alkyl or cycloalkyl substitutent is preferably one of 2–12 carbon atoms and the alkyl substitutent is preferably an unsubstituted alkyl. While a limited number of substituents may be present on the alkyl group, they should not lend polarity to the molecule to the extent that its solubility in the lubricating oil is impaired.

Preferred compounds are those in which a major portion of the antioxidant composition is a cycloakyl-substituted polyaromatic thiophene.

Preferred thiophene compounds are thoss wherein the paraffinic:aromatic weight ratio is generally 60–30:-40–70, and most preferably 40–60:60–40. The aliphatic:-naphthenic weight ratio is most broadly 80–20:20–80, and most preferably 60–40:40–60. The thiophenic:-(aromatic+paraffinic) weight ratio is generally 10–70:-90–30, and most preferably 30–50:70–50.

Aromatic distillates containing such compounds are exemplified below and surprisingly often have a negative viscosity index. Such distillates typically have a kinematic viscosity of about 1–10 Centistokes at 100 degrees C. This has not proven to adversely affect the viscosity index of lubricating oils to which they are added, but requires that the amount of added antioxidant be kept below that at which the viscosity index of the lubricating oil would be reduced by an unacceptable amount for the purpose in which it will be employed.

Preferred materials for use with the antioxidant compositions of the present invention are the lubricating oils as previously defined, both natural and synthetic, particularly petroleum distillates and especially motor oils for use in internal combustion engines. Such materials include but are not limited to automotive oils, heavy duty oils, marine oils, railroad oils, aviation lubes, transmission fluid, and hydraulic fluids. More generally, the additive is useful with any parrafinic and/or naphthenic based stocks in which oxidation is a significant concern wherein the viscosity is from approximately 3–60 centistokes. The oils are preferably natural, but may also be synthetic, e.g., polyalphaolefins and synthetic esters.

Other materials which can be used with the process aspect of this invention are those which upon oxidative degradation form $C_7$-asphaltenes as an intermediate product.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever. In the following Examples, the temperatures are set forth uncorrected in degrees Celsius; unless otherwise indicated, all parts and percentages are by weight.

EXAMPLE 1

Accelerated Air-Oxidation of Untreated Lube Basestocks

Four lube basestocks are air oxidized at 300 degrees C. using an air sparger and high speed agitation (540 RPM). The rate of $C_7$-asphaltene formation is determined by periodically taking a sample and determining the $C_7$-asphaltene (n-heptane insoluble) using a standard analytical method (reflux for one hour, 1:50, feed: n-heptane ratio, 4–8 micron filter). The $C_7$-asphaltene vs time relationship is presented in FIG. 1.

EXAMPLES 2–4

Figure 2:
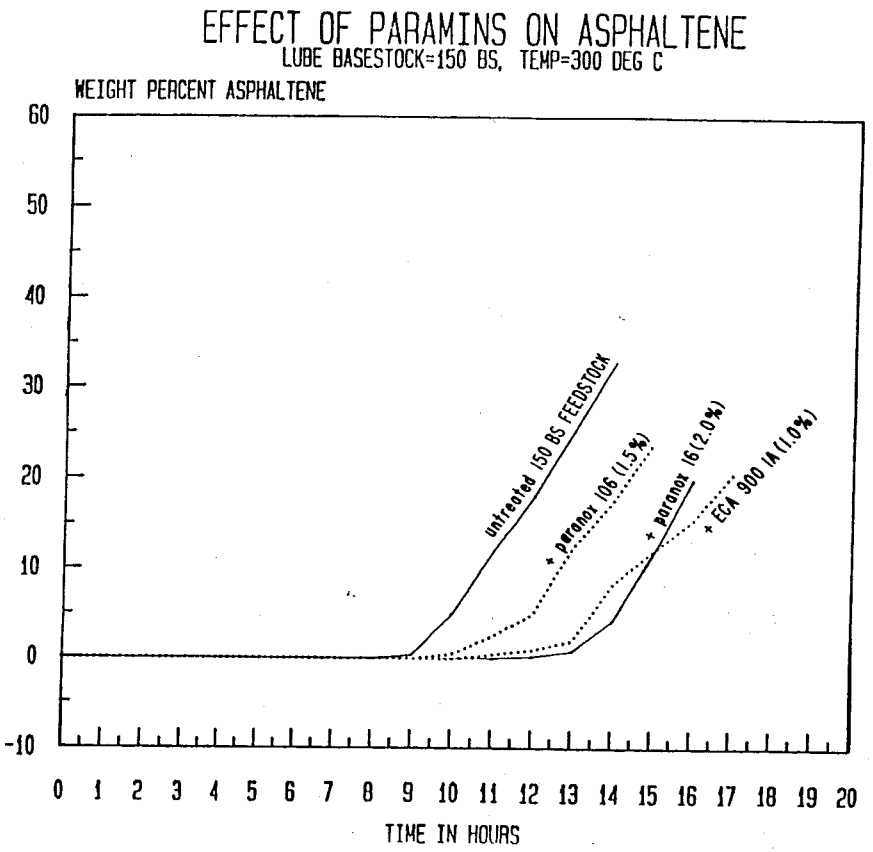
FIG. 2 shows the rate of $C_7$-asphaltene formation in a single lubricating oil basestock (150 BS) at 300 degrees C. containing no added antioxidant (control) and various amounts of added antioxidants.

Accelerated Oxidation of Lube Basestock Treated with Commercial Paramins Additives Example 1 is repeated using a lube basestock 150 BS treated with ECA9001A (1.0%), Paranox 106 (1.5 wt %) and Paranox 16 (2.0 wt %). The effect of the three additives on $C_7$-asphaltene formation rate is illustrated in FIG. 2.

EXAMPLES 5–7

Accelerated Oxidation of Lube Basestock Treated with Aromatic Oils (CB-D and CB-2-D)

Figure 3:
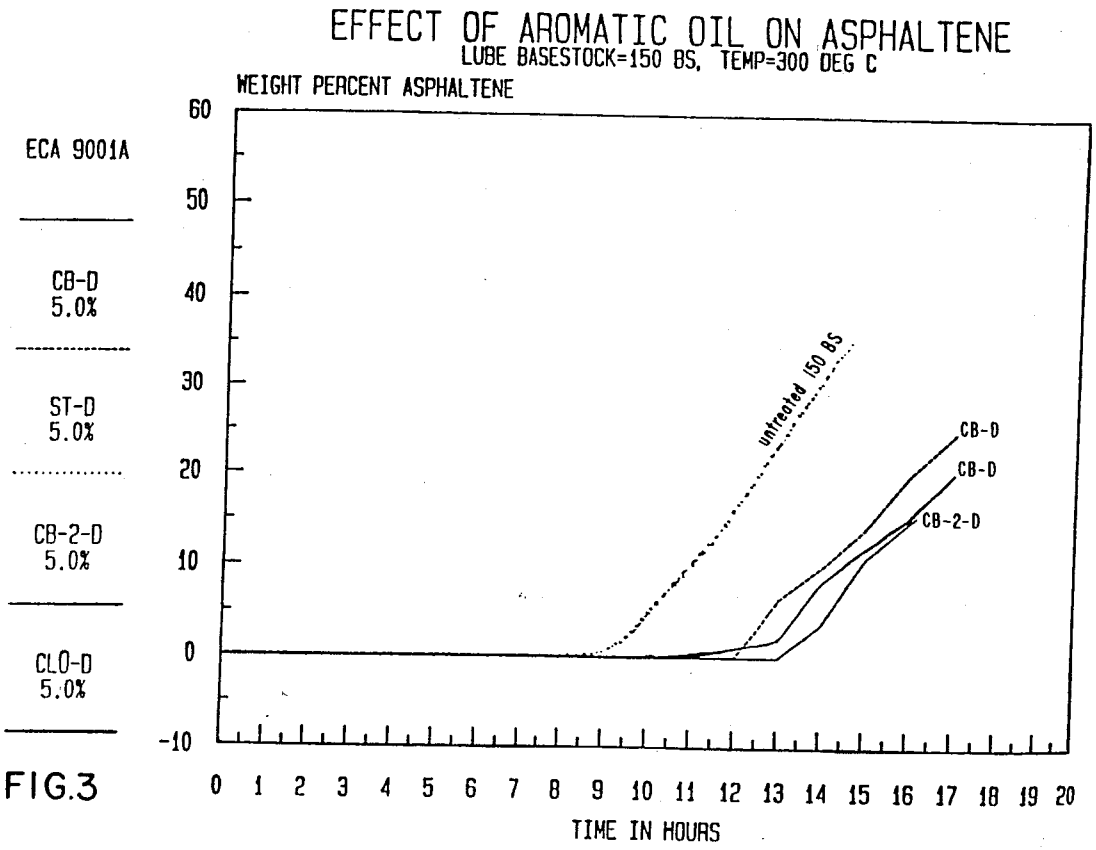
FIG. 3 shows the rate of $C_7$-asphaltene formation in a single lubricating oil basestock (150 BS) at 300 degrees C. containing no added antioxidant (control) and various amounts of antioxidants according to the invention.

Example 1 is repeated using a lube basestock 150 BS treated with 2.5% of CB-D (example 5), 5.0% of CB-D (example 6) and 5.0% of CB-2D (example 7), CB being a designation utilized to identify an additive according to the invention. Details of the rate of $C_7$- asphaltene formation vs time are illustrated in FIG. 3. The data in FIG. 3 clearly demonstrate that the two CB aromatic oils tested are effective additives for reducing the rate of $C_7$-asphaltene with performance equivalent to commercial additives, while being considerably less expensive.

The preceding examples can be repeated with similar success by substituting the generically or specifically described reactants and/or operating conditions of this invention for those specifically used in the examples. From the foregoing description, one skilled in the art to which this invention pertains can easily ascertain the essential characteristics thereof and, without departing from the spirit and scope of the present invention, can make various changes and modifications to adapt it to various usages and conditions.

INDUSTRIAL APPLICABILITY

As can be seen from the present specification and examples, the present invention is industrially useful in providing inexpensive lubricating oil antioxidants.

What is claimed is:

1. In a lubricating oil composition comprising an organic lubricating oil susceptible to oxidative polymerization leading to the formation of C-7 asphaltenes, the improvement which comprises an antioxidant effective amount of at least one member selected from the group consisting of indo-thiophenes, naphtho-thiophenes, naphthenonaphtho-thiophenes, acenaphthalene-thiophenes, anthraceno-thiophenes, naphthenophenanthro-thiophenes, pyreno-thiophenes, chryseno-thiophenes, cholanthreno-thiophenes, indeno-thiophenes and naphthenobenzo-thiophenes said at least one member being present in an amount equal to greater than 0.1% by weight of the composition, each of said at least one members being substituted by an alkyl or cycloalkyl group of 1–12 carbon atoms to provide solubility of said member in said lubricating oil composition.

2. The lubricating oil composition according to claim 1 wherein the antioxidant is a cycloalkyl-substituted polyaromatic thiophene.

3. The lubricating oil composition according to claim 1 wherein the alkyl or cycloalkyl substitutent is one of 2–12 carbon atoms.

4. The lubricating oil composition according to claim 1 wherein the alkyl or cycloalkyl substitutent is an unsubstituted alkyl.

5. The lubricating oil composition according to claim 1 wherein the antioxidant is an aromatic distillate having a negative viscosity index.

6. The lubricating oil composition according to claim 1, wherein the distillate has a kinematic viscosity of about 1–10 Centistokes at 100 degrees C.

7. The lubricating oil composition according to claim 1, wherein the lubricating oil is a petroleum distillate.

8. The lubricating oil composition according to claim 7, wherein the lubricating oil is a motor oil.

9. The lubricating oil composition as defined by claim 1, wherein each of said at least one members has a paraffinic:aromatic weight ratio of 60–30:40–70; an aliphatic:naphthenic weight ratio of 80–20:20–80; and a thiophenic:(aromatic+paraffinic) weight ratio of generally 10–70:90–30.

10. The lubricating oil composition as defined by claim 9 wherein each of said at least one members has a paraffinic:aromatic weight ratio of 60–40:40–60, an aliphatic:naphthenic weight ratio of 60–40:40–60, and a thiophenic:(aromatic+paraffinic) weight ratio of 30–50:70–50.

11. The lubricant oil composition as defined by claim 1 wherein said at least one member is formed of a cat cracker bottom.

12. The lubricant oil composition as defined by claim 1 wherein said at least one member is formed of steam cracker residue.

13. In a lubricating oil composition comprising an organic lubricating oil susceptible to oxidative polymerization leading to the formation of C-7 asphaltenes, the improvement which comprises an antioxidant effective amount of at least one alkyl or cycloalkyl-substituted thiophene containing a polycondensed aromatic compound of 2–6 rings having an alkyl or cycloalkyl substitutent of 1–12 carbon atoms to provide solubility of said at least one thiophene in said lubricating oil composition.

14. The lubricating oil composition according to claim 13 wherein the antioxidant is a cycloalkyl-substituted polyaromatic thiophene.

15. The lubricating oil composition according to claim 13 wherein the alkyl of cycloalkyl substituent is one of 2–12 carbon atoms.

16. The lubricating oil composition according to claim 13 wherein the alkyl or cycloalkyl substitutent is an unsubstituted alkyl.

17. The lubricating oil composition according to claim 13 wherein the antioxidant is an aromatic distillate having a negative viscosity index.

18. The lubricating oil composition according to claim 17, wherein the distillate has a kinematic viscosity of about 1–10 Centistokes at 100 degrees C.

19. The lubricating oil composition according to claim 13, wherein the lubricating oil is a petroleum distillate.

20. The lubricating oil composition according to claim 13, wherein the lubricating oil is a motor oil.

21. The lubricating oil composition as defined by claim 13, wherein each of said at least one compounds has a paraffinic:aromatic weight ratio of 60–30:40–70; an aliphatic:naphthenic weight ratio of 80–20:20–80; and a thiophenic:(aromatic+paraffinic) weight ratio of generally 10–70:90–30.

22. The lubricating oil composition as defined by claim 21 wherein each of said at least one compounds has a paraffinic:aromatic weight ratio of 60–40:40–60, an aliphatic:naphthenic weight ratio of 60–40:40–60, and a thiophenic:(aromatic+paraffinic) weight ratio of 30–50:70–50.

23. The lubricant oil composition as defined by claim 13 wherein said at least one member is formed of a cat cracker bottom.

24. The lubricant oil composition as defined by claim 13 wherein said at least one member is formed of steam cracker residue.

25. A method of reducing the coking tendency of a lubricating oil, said method comprising the step of adding to said lubricating oil an antioxidant effective amount of at least one alkyl or cycloalkyl-substituted thiophene selected from the group consisting of indo-thiophenes, naphtho-thiophenes, naphthenonaphtho-thiophenes, acenaphthalene-thiophenes, anthraceno-thiophenes, naphthenophenanthro-thiophenes, pyreno-thiophenes, chryseno-thiophenes, cholanthreno-thiophenes, indeno-thiophenes and naphthenobenzo-thiophenes in an amount equal to greater than 0.1% by weight of the composition.

26. The method as defined by claim 25 wherein the the alkyl or cycloalkyl substitutent is one of 2–12 carbon atoms.

27. The method as defined by claim 20 wherein the alkyl or cycloalkyl substitutent is an unsubstituted alkyl.

28. The method as defined by claim 25 wherein the antioxidant is an aromatic distillate having a negative viscosity index.

29. The method as defined by claim 28 wherein the distillate has a kinematic viscosity of about 1–10 Centistokes at 100 degrees C.

30. The method as defined by claim 25 wherein the lubricating oil is a petroleum distillate.

31. The method as defined by claim 25 wherein the lubricating oil is a motor oil.

32. The method as defined by claim 25 further comprising adding said at least one member in the form of a cat cracker bottom.

33. The method as defined by claim 25 further comprising adding at least one member in the form of a steam cracker residue.

* * * * *